US012291825B2

(12) United States Patent
Smart et al.

(10) Patent No.: US 12,291,825 B2
(45) **Date of Patent: *May 6, 2025**

(54) MODULAR FOUNDATION SYSTEM FOR PLATFORM ASSEMBLIES

(71) Applicant: MULTY HOME LP, Concord (CA)

(72) Inventors: Dylan Smart, Langham (CA); Derek Erdman, Toronto (CA); Stevenson Tom, Markham (CA); Stephen Dixon, Oakville (CA)

(73) Assignee: MULTY HOME LP, Concord (CA)

( * ) Notice: Subject to any disclaimer, the term of this patent is extended or adjusted under 35 U.S.C. 154(b) by 432 days.

This patent is subject to a terminal disclaimer.

(21) Appl. No.: 17/616,894

(22) PCT Filed: Jun. 4, 2020

(86) PCT No.: PCT/CA2020/050773

§ 371 (c)(1),
(2) Date: Dec. 6, 2021

(87) PCT Pub. No.: WO2020/243837

PCT Pub. Date: Dec. 10, 2020

(65) Prior Publication Data

US 2022/0307203 A1 Sep. 29, 2022

Related U.S. Application Data

(63) Continuation of application No. PCT/CA2019/050774, filed on Jun. 4, 2019, and a (Continued)

(30) Foreign Application Priority Data

Jun. 4, 2019 (CA) ..... CA 3045095
Jun. 4, 2019 (WO) ..... PCT/CA2019/050774
Nov. 28, 2019 (CA) ..... CA 3062958

(51) Int. Cl.
*E01C 5/00* (2006.01)
*E01C 5/14* (2006.01)

(Continued)

(52) U.S. Cl.
CPC ..... *E01C 5/001* (2013.01); *E01C 5/14* (2013.01); *E01C 5/223* (2013.01); *E01C 19/52* (2013.01)

(58) Field of Classification Search
CPC . E01C 5/001; E01C 5/14; E01C 5/223; E01C 5/52; E01C 19/52

(Continued)

(56) References Cited

U.S. PATENT DOCUMENTS 101,638 A * 4/1870 McAlister ..... E04F 15/14 404/42
1,970,037 A * 8/1934 Fischer ..... E01C 5/226 404/46

(Continued)

FOREIGN PATENT DOCUMENTS

EP 0869219 A2 10/1998
GB 2 481 441 A 12/2011

(Continued)

OTHER PUBLICATIONS

Extended Search Report, EP 19815561.6, dated Mar. 25, 2022 (7 pp.).

(Continued)

*Primary Examiner* — Raymond W Addie
(74) *Attorney, Agent, or Firm* — Eversheds Sutherland (US) LLP

(57) ABSTRACT

Modular foundation systems for assembling floating platform assemblies. Modular foundation systems comprise a base mat sized to engage retaining members within a grooves formed in the upper surface of the base mat. Using (Continued)

a combination of a number of base mats and retaining members, a platform assembly of virtually any desired size and shape can be readily assembled.

20 Claims, 13 Drawing Sheets

Related U.S. Application Data continuation of application No. 16/431,719, filed on Jun. 4, 2019, now Pat. No. 11,473,248.

(51) Int. Cl.
*E01C 5/22* (2006.01)
*E01C 19/52* (2006.01)

(58) Field of Classification Search
USPC ..... 404/31, 34–46
See application file for complete search history.

(56) References Cited

U.S. PATENT DOCUMENTS 2,977,612 A * 4/1961 Frost ..... E01D 15/14 14/27
4,875,800 A 10/1989 Hicks
4,932,182 A * 6/1990 Thomasson ..... E04F 15/12 52/387
5,352,141 A * 10/1994 Shields ..... B63H 23/34 416/129
5,761,867 A * 6/1998 Carling ..... E01C 13/045 52/177
6,171,015 B1 * 1/2001 Barth ..... E01C 5/001 404/34
6,339,908 B1 * 1/2002 Chuang ..... E04F 15/04 52/177
7,617,467 B2 * 11/2009 Bell ..... G06F 30/367 716/136
7,617,647 B2 * 11/2009 Turner ..... E04F 15/08 52/390
8,146,303 B2 4/2012 Gibson et al.
8,747,018 B2 * 6/2014 Smith ..... E01C 5/00 404/34
8,784,001 B1 * 7/2014 Phillips ..... E21B 41/0021 404/46
8,973,326 B2 * 3/2015 Lenoci ..... E04F 15/02044 52/384
9,038,341 B2 5/2015 Lam et al.

FOREIGN PATENT DOCUMENTS

KR 10-081075 B1 3/2008
KR 100809014 B1 3/2008
KR 101 038 704 B1 6/2011
WO 2005/040523 A1 5/2005
WO 2010079462 A1 7/2010

OTHER PUBLICATIONS

International Search Report and Written Opinion, PCT/CA2020/050773, dated Sep. 2, 2020 (19 pp.).
Office Action, NZ771695, dated May 28, 2024 (5 pp.).
1 Extended Search Report, EP 19815561.6, dated Mar. 25, 2022 (7 pp.).

* cited by examiner

A

B

C

Variable gap distances

Separation Walls in sections or non-continuous

MODULAR FOUNDATION SYSTEM FOR PLATFORM ASSEMBLIES

FIELD

The invention relates to non-traditional platform assemblies for residential, rural, industrial and commercial applications. More specifically, to a modular foundation system for floating platform assemblies that are rapidly assembled and disassembled into a variety of sizes and configurations at a desired location.

BACKGROUND

In construction projects, it is common to have unprepared surfaces over which movement of workers and equipment can be difficult and potentially dangerous. For example, when working around a construction site at ground level, the surrounding ground may be uneven, or subject to moisture from either the weather or ongoing operations such that it would present a muddy surface that might be too soft for equipment to be moved, or dangerous for workers to walk on. Moreover, in more remote construction projects workers may live for days/weeks in trailers at the site and wish to have a clean safe outdoor living surface.

Thus, it is often desirable to have platform assemblies over which workers can move from location to location at a worksite, and to provide an even surface over which to move equipment or to simply have a defined outdoor living surface for activities.

Similarly, it is frequently desirable as part of residential projects to provide for indoor or outdoor decking in order to enhance the aesthetic appearance and/or utility of a property.

A variety of decking systems have been developed that typically suffer from one or more limitations, including ease of assembly, cost of components, and adaptability to varying conditions.

A rapidly deployed platform assembly which could be used in permanent or temporary residential and commercial areas would be desirable.

The discussion of the background herein is included to explain the context of the inventions described herein. This is not to be taken as an admission that any of the material referred to was published, known, or part of the common general knowledge as of the priority date of any of the claims.

SUMMARY OF THE INVENTION

Herein described is modular foundation system for floating platform assemblies that can be rapidly assembled and disassembled into a variety of sizes and configurations on any variety of surfaces at any desired location for residential, rural, commercial and industrial areas.

The invention is applicable, for example, in the building of a platform assembly that can be a boat dock, decking, patio, walkway, paths, boardwalks, jetties, piers, promenades, verandahs, balconies and small crossings. The platform assembly can be assembled on any type of ground surface such as dirt, sand, gravel, sod, cracked pavement, concrete, wood, and the like.

The invention described herein encompasses components of the modular foundation system, a floating platform assembly incorporating such components, kits and methods for assembly of the floating platform assembly.

The invention described herein comprises in an aspect a re-useable, eco-friendly, transportable base mat that is structurally robust.

The invention described herein also comprises a modular foundation system comprising the re-useable, eco-friendly, transportable base mats described herein.

In a non-limiting embodiment, is described modular systems for assembling ground-based decks for recreational, construction site and other purposes. In one embodiment, a collection of modules can be used to provide a base on which to assemble a series of walkway members, and to provide means to create complex walkway patterns if desired, included junctions of walkway segments at various angles.

Thus one embodiment, the present disclosure provides a molded unitary base mat for use in constructing a modular deck in conjunction with at least one retaining member having a length and a width, a lower retaining member surface, an upper retaining member surface and retaining member sides, the molded unitary base mat having: a length and a width, a lower molded unitary base mat surface, an upper molded unitary base mat surface, and molded unitary base mat sides; at least one groove extending the length of the molded unitary base mat and having an interior width corresponding to the exterior width of a retaining member and being configured to engage at least a portion of the lower retaining member surface and retaining member sides of the retaining member; wherein the molded unitary base mat can be placed on a surface in alignment with at least one similar molded unitary base mat such that the plurality of molded unitary base mats will define a desired perimeter, shape and area of a modular deck being constructed; the grooves of adjacent molded unitary base mats being alignable with each other such that linear retaining members can be positioned therethrough to retain the molded unitary base mats in relative position to each other in the desired perimeter, shape and area of the modular deck.

In some embodiments, there is also provided a kit for the construction of a modular deck, said kit comprising a plurality of molded unitary base mats each having: a length and a width, a lower molded unitary base mat surface, an upper molded unitary base mat surface, and molded unitary base mat sides; at least one groove extending the length of the molded unitary base mat and having an interior width corresponding to the exterior width of a retaining member having a length and a width, a lower retaining member surface, an upper retaining member surface and retaining member sides; said grooves each being configured to engage at least a portion of the lower retaining member surface and retaining member sides of the at least one retaining member; the number of molded unitary base mats within the kit being of sufficient shape and size to permit the creation of a modular deck on a surface by alignment of said molded unitary base mats in edge to edge proximity to each other having the grooves in adjacent molded unitary base mats aligned such that at least one retaining member can be positioned within the grooves of the molded unitary base mats to retain the molded unitary base mats in relative position to each other in the desired perimeter, shape and area of the modular deck.

In some embodiments, the kit further comprises at least one retaining member to be used in assembly of the modular deck and retention of the molded unitary base mats in position and alignment to each other. In some embodiments, the retaining members comprise linear dimensional construction materials separately available, and the grooves in the molded unitary base mat are sized to accommodate such linear dimensional construction materials. In some embodiments, the linear dimensional construction materials comprise dimensional lumber or construction composite.

The present disclosure also provides for a modular deck for use on a surface, said modular deck comprising: at least one retaining member having a length and a width, a lower retaining member surface, an upper retaining member surface and retaining member sides; a plurality of molded unitary base mats each having: at least one a length and a width, a lower molded unitary base mat surface, an upper molded unitary base mat surface, and molded unitary base mat sides; at least one groove extending the length of the molded unitary base mat and having an interior width corresponding to the exterior width of a retaining member and each being configured to engage at least a portion of the lower retaining member surface and retaining member sides of the at least one retaining member; the molded unitary base mats being of sufficient shape and size to permit the creation of a modular deck of a desired perimeter, shape and area on a surface and being aligned in edge to edge proximity to each other; and a retaining member can be positioned within the corresponding grooves of adjacent molded unitary base mats to retain the molded unitary base mats in relative position to each other in the desired perimeter, shape and area of the modular deck.

The present disclosure also provides a method of constructing a modular deck, the method comprising: providing a plurality of molded unitary base mats, each molded unitary base mat having a length and a width, a lower molded unitary base mat surface, an upper molded unitary base mat surface, and molded unitary base mat sides; providing a plurality of retaining members, each retaining member having a length and a width, lower retaining member surface, an upper retaining member surface, and retaining member sides; wherein each molded unitary base mat further comprises at least one groove, the at least one groove extending the length of the molded unitary base mat, and having a width sized to engage a retaining member, and wherein the at least one groove is configured to engage at least a portion of the lower retaining member surface and retaining member sides of a retaining member; positioning the plurality of molded unitary base mats on a surface on which the modular deck is to be constructed, such that the plurality of molded unitary base mats will define a desired perimeter, shape and area of the modular deck being constructed; and sequentially positioning retaining members in molded unitary base mats grooves until the desired perimeter, shape and area of the modular deck is substantially achieved.

In some embodiments of the method, longitudinal orientation of a retaining member in the modular deck is defined by longitudinal orientation of the groove in the molded unitary base mat that engages the retaining member.

In some embodiments of the method, the modular deck comprises a plurality of sections in which orientation of retaining members within each section is distinct from orientation of retaining members in an adjacent section.

In some embodiments, the method further comprises applying reflective markings at desired locations on the modular deck.

In some embodiments of the method, a retaining member is secured to the molded unitary base mat which engages it with a fastener, and adhesive and combinations thereof.

In some embodiments, the present disclosure provides a modular deck constructed as described herein.

An overall platform assembly is comprised of a plurality of abutting panels supported by the modular foundation system of the invention comprising a plurality of base mats.

Aspects of the Invention

A re-useable, eco-friendly transportable base mat.

A re-useable, eco-friendly rubber unitary transportable base mat.

A set of re-useable, eco-friendly transportable base mats.

A modular foundation system for a floating platform assembly comprising a set of re-useable, eco-friendly transportable base mats.

1. A molded unitary base mat for use in constructing a modular deck in conjunction with at least one retaining member having a length and a width, a lower retaining member surface, an upper retaining member surface and retaining member sides, the molded unitary base mat having:
   a. a length and a width, a lower molded unitary base mat surface, an upper molded unitary base mat surface, and molded unitary base mat sides;
   b. at least one groove extending the length of the molded unitary base mat and having an interior width corresponding to the exterior width of a retaining member and being configured to engage at least a portion of the lower retaining member surface and retaining member sides of the retaining member;
   wherein the molded unitary base mat can be placed on a surface in alignment with at least one similar molded unitary base mat such that the plurality of molded unitary base mats will define a desired perimeter, shape and area of a modular deck being constructed; the grooves of adjacent molded unitary base mats being alignable with each other such that linear retaining members can be positioned therethrough to retain the molded unitary base mats in relative position to each other in the desired perimeter, shape and area of the modular deck.
2. A kit for the construction of a modular deck, said kit comprising a plurality of molded unitary base mats each having:
   a. a length and a width, a lower molded unitary base mat surface, an upper molded unitary base mat surface, and molded unitary base mat sides;
   b. at least one groove extending the length of the molded unitary base mat and having an interior width corresponding to the exterior width of a retaining member having a length and a width, a lower retaining member surface, an upper retaining member surface and retaining member sides; said grooves each being configured to engage at least a portion of the lower retaining member surface and retaining member sides of the at least one retaining member;
   the number of molded unitary base mats within the kit being of sufficient shape and size to permit the creation of a modular deck on a surface by alignment of said molded unitary base mats in edge to edge proximity to each other having the grooves in adjacent molded unitary base mats aligned such that at least one retaining member can be positioned within the grooves of the molded unitary base mats to retain the molded unitary base mats in relative position to each other in the desired perimeter, shape and area of the modular deck.
3. The kit of claim 2 further comprising at least one retaining member to be used in assembly of the modular deck and retention of the molded unitary base mats in position and alignment to each other.

4. The kit of claim 2 wherein the retaining members comprise linear dimensional construction materials separately available, and the grooves in the molded unitary base mat are sized to accommodate such linear dimensional construction materials.
5. The kit of claim 4 wherein the linear dimensional construction materials comprise dimensional lumber or construction composite.
6. A modular deck for use on a surface, said modular deck comprising:
   a. At least one retaining member having a length and a width, a lower retaining member surface, an upper retaining member surface and retaining member sides;
   b. a plurality of molded unitary base mats each having:
      i. at least one a length and a width, a lower molded unitary base mat surface, an upper molded unitary base mat surface, and molded unitary base mat sides;
      ii. at least one groove extending the length of the molded unitary base mat and having an interior width corresponding to the exterior width of a retaining member and each being configured to engage at least a portion of the lower retaining member surface and retaining member sides of the at least one retaining member;

the molded unitary base mats being of sufficient shape and size to permit the creation of a modular deck of a desired perimeter, shape and area on a surface and being aligned in edge to edge proximity to each other; and a retaining member can be positioned within the corresponding grooves of adjacent molded unitary base mats to retain the molded unitary base mats in relative position to each other in the desired perimeter, shape and area of the modular deck.
7. A method of constructing a modular deck, the method comprising:
   a. providing a plurality of molded unitary base mats, each molded unitary base mat having a length and a width, a lower molded unitary base mat surface, an upper molded unitary base mat surface, and molded unitary base mat sides;
   b. providing a plurality of retaining members, each retaining member having a length and a width, lower retaining member surface, an upper retaining member surface, and retaining member sides;
   c. wherein each molded unitary base mat further comprises at least one groove, the at least one groove extending the length of the molded unitary base mat, and having a width sized to engage a retaining member, and wherein the at least one groove is configured to engage at least a portion of the lower retaining member surface and retaining member sides of a retaining member;
   d. positioning the plurality of molded unitary base mats on a surface on which the modular deck is to be constructed, such that the plurality of molded unitary base mats will define a desired perimeter, shape and area of the modular deck being constructed; and
   e. sequentially positioning retaining members in molded unitary base mats grooves until the desired perimeter, shape and area of the modular deck is substantially achieved.
8. The method of claim 7, wherein longitudinal orientation of a retaining member in the modular deck is defined by longitudinal orientation of the groove in the molded unitary base mat that engages the retaining member.
9. The method of claim 7 wherein the modular deck comprises a plurality of sections in which orientation of retaining members within each section is distinct from orientation of retaining members in an adjacent section.
10. The method of claim 7, furthering comprising applying reflective markings at desired locations on the modular deck.
11. The method of claim 7, wherein a retaining member is secured to the molded unitary base mat which engages it with a fastener, and adhesive and combinations thereof
12. The modular deck constructed in accordance with the method of claim 7.
13. A re-useable base mat of a unitary molded body comprising:
   a top surface with spaced apart upwardly extending dividers forming a plurality of channels, each of said plurality of channels configured for receiving a retaining member;
   a bottom ground engaging surface; and
   laterally extending side support members, wherein the length of the upwardly extending dividers is less than the thickness of the retaining member laid into the channel.
14. The re-useable base mat of claim 13, wherein the base mat is formed from recycled rubber.
15. The re-useable base mat of claim 14, wherein the recycled rubber comprises a mixture of crumb rubber and polyolefin in a ratio of from about 20%:80% by weight to 80%:20% by weight.
16. The re-useable base mat of claim 14, further comprising up to about 10% by weight additives selected from the group consisting of titanium dioxide, UV stabilizers, calcium carbonate, talc, flame retardants and combinations thereof.
17. The re-useable base mat of any one of claims 14 to 16, further comprising up to about 10% by weight colorant.
18. The re-useable base mat of any one of claims 13 to 17, wherein each of said spaced apart upwardly extending dividers have chamfered ends.
19. The re-useable base mat of any one of claims 13 to 17, wherein one or more of said spaced apart upwardly extending dividers are not continuous.
20. The re-useable base mat of any one of claims 13 to 19, wherein one or more of said spaced apart upwardly extending dividers are of a different length.
21. The re-useable base mat of any one of claims 13 to 20, wherein the bottom ground engaging surface is textured.
22. The re-useable base mat of any one of claims 13 to 21, wherein the plurality of channels comprise one or more different widths.
23. The re-useable base mat of any one of claims 13 to 22, comprising five channels.
24. The re-useable base mat of any one of claims 13 to 22, comprising three channels.
25. The re-useable base mat of any one of claims 13 to 22, comprising five channels.
26. The re-useable base mat of any one of claims 13 to 22, comprising two to ten channels.
27. The re-useable base mat of any one of claims 13 to 26, wherein said base mat is transportable and eco-friendly.

28. A modular foundation system comprising a plurality of the re-useable base mat of any one of claims 13 to 28.
29. A panel comprising one or more of the re-useable base mat of any one of claims 13 to 27, and a retainer member in each of said channels.
29. A floating platform assembly comprising a plurality of adjoined panels of claim 29.
30. The floating platform assembly of claim 29, further comprising a border at the periphery of the assembly.
31. The floating platform assembly of claim 29 or 30 wherein said platform assembly is not permanent.
32. The floating platform assembly of claim 29 or 30, wherein the platform assembly is a boat dock, decking, patio, walkway, paths, boardwalks, jetties, pier, promenade, verandah, balcony and small crossings.
33. The floating platform assembly of claim 32, assembled on a ground surface selected from dirt, sand, gravel, sod, cracked pavement, wood, stones and cement.
34. A kit comprising one or more re-useable base mat of any one of claims 13 to 26 and instructions for use to make a floating platform assembly.

BRIEF DESCRIPTION OF THE DRAWINGS

The following description of typical aspects described herein will be better understood when read in conjunction with the appended drawings. For the purpose of illustrating the invention, there are shown in the drawings aspects which are presently typical. It should be understood, however, that the invention is not limited to the precise arrangements and instrumentalities of the aspects shown in the drawings. It is noted that like reference numerals refer to like elements across different embodiments as shown in the drawings and referred to in the description.

The description herein will be more fully understood in view of the following drawings.

DESCRIPTION

Figure 1:
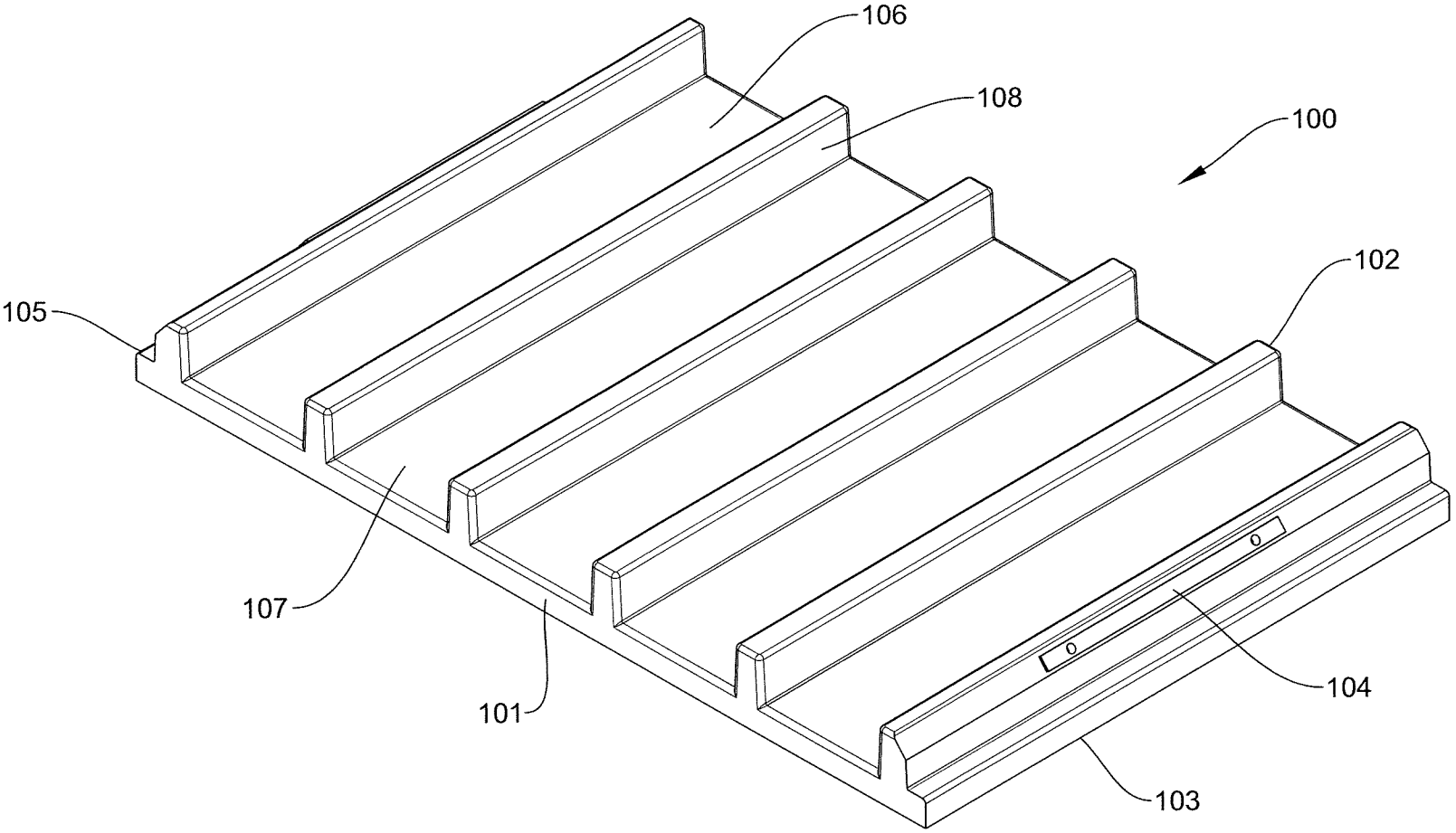
FIG. 1 shows an embodiment of a base mat for use in assembling a foundation for a platform assembly in accordance with the present invention.

All publications, patent applications, patents, and other references mentioned herein are incorporated by reference in their entirety. The publications and applications discussed herein are provided solely for their disclosure prior to the filing date of the present application. Nothing herein is to be construed as an admission that the present invention is not entitled to antedate such publication by virtue of prior invention. In addition, the materials, methods, and examples are illustrative only and are not intended to be limiting.

Unless defined otherwise, all technical terms used herein have the same meaning as commonly understood by one of ordinary skill in the art to which the invention pertains. Although any methods and materials similar or equivalent to those described herein can be used in the practice for testing of the present invention, the typical materials and methods are described herein.

It is also to be understood that the terminology used herein is for the purpose of describing particular aspects only, and is not intended to be limiting. The articles "a" and "an" are used herein to refer to one or to more than one (i.e., to at least one) of the grammatical object of the article. By way of example, "an element" means one element or more than one element.

As used herein, the terms "invention" or "present invention" are non-limiting terms and not intended to refer to any single aspect of the particular invention but encompass all possible aspects as described in the specification and the claims.

As used herein the terms 'comprises', 'comprising', 'includes', 'including', 'having' and their inflections and conjugates denote 'including but not limited to' and are to be understood to be open-ended, e.g., to mean including but not limited to.

As used herein, the term "about" refers to variation in the numerical quantity. In one aspect, the term "about" means within 10% of the reported numerical value. In another aspect, the term "about" means within 5% of the reported numerical value. Yet, in another aspect, the term "about" means within 10, 9, 8, 7, 6, 5, 4, 3, 2, or 1% of the reported numerical value.

Should a range of values be recited, it is merely for convenience or brevity and includes all the possible sub-ranges as well as individual numerical values within and about the boundary of that range. Any numeric value, unless otherwise specified, includes also practical close values and integral values do not exclude fractional values. Sub-range values and practically close values should be considered as specifically disclosed values.

It will be understood that any component defined herein as being included may be explicitly excluded from the claimed invention by way of proviso or negative limitation.

As may be used herein the terms 'close', 'approximate' and 'practically' denote a respective relation or measure or amount or quantity or degree that has no adverse consequence or effect relative to the referenced term or embodiment or operation or the scope of the invention.

As may be used herein any terms referring to geometrical relationships such as 'vertical', 'horizontal', 'parallel', 'opposite', 'straight', "lateral", "parallel", "perpendicular" and other angular relationships denote also approximate yet functional and/or practical, respective relationships.

As may be used herein the term 'substantially' (or synonyms thereof) denote with respect to the context a measure or extent or amount or degree that encompass a large part or most of a referenced entity, or an extent at least moderately or much greater or larger or more effective or more important relative to a referenced entity or with respect to the referenced subject matter.

As used herein the term 'may' denotes an option or an effect which is either or not included and/or used and/or implemented and/or occurs, yet the option constitutes at least a part of some embodiments of the invention or consequence thereof, without limiting the scope of the invention.

The phrase "and/or," as used herein in the specification and in the claims, should be understood to mean "either or both" of the elements so conjoined, e.g., elements that are conjunctively present in some cases and disjunctively present in other cases. Other elements may optionally be present other than the elements specifically identified by the "and/or" clause, whether related or unrelated to those elements specifically identified unless clearly indicated to the contrary.

As used herein in the specification and in the claims, "or" should be understood to have the same meaning as "and/or" as defined above. For example, when separating items in a list, "or" or "and/or" shall be interpreted as being inclusive, e.g., the inclusion of at least one, but also including more than one, of a number or list of elements, and, optionally, additional unlisted items. In general, the term "or" as used herein shall only be interpreted as indicating exclusive alternatives (e.g. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein "a plurality" is understood to be any number greater than one. "Plurality" means "two or more".

It should also be understood that, unless clearly indicated to the contrary, in any methods claimed herein that include more than one step or act, the order of the steps or acts of the method is not necessarily limited to the order in which the steps or acts of the method are recited.

As used herein "base mat" is synonymous and thus interchangeable with "foundation mat" and "mat".

As used herein "rib" is synonymous and thus interchangeable with "divider".

As used herein "spaces" and "grooves" with respect to the unitary body of the mat is synonymous and thus interchangeable with "channel".

As used herein "lateral edges" is synonymous and thus interchangeable with "side support".

As used herein "walkway members" and "retaining members" are horizontal load bearing members that are laid into the channels of the mat. These can be for example, 2"×4" lumber or 1"×6" planks also called deck boards. These can be of any desired wood, or suitable wood composite material and cut into any desired length.

As used herein "floating" is meant the modular foundation system comprising one or more base mats is not attached/affixed to the ground and further that the base mats support retaining members thereon that are not permanently attached to the base mats. Thus floating platform assembly is meant that it is readily assembled and disassembled and not permanently fixed. Permanent fasteners are not required.

As described herein is a system for forming a modular foundation for supporting a substantially level surface thereon on which people and pets can stand or walk or things can be placed or moved thereover. The level surface is assembled on the modular foundation and is a floating platform assembly that can take the form of for example a deck, deck surround, patio or stage for any desired location. The modular foundation can be assembled in any number of configurations for supporting a variety of sizes and configurations of platform assemblies. The modular foundation comprises one or more base mats placed on a surface at a desired location in a desired configuration on which boards are laid to provide a platform assembly.

The system is designed to be assembled without permanent fasteners to allow for expansion, reconfiguration or relocation, or addition of deck accessories that functionally engage. One ideal manufacturing method of one or any of the system components is compression molded post-consumer and/or industrial thermo-plastic waste.

The present invention particularly is a modular, portable and interlocking decking system that is predominately and ideally comprised of 100% post-consumer and/or industrial thermo-plastic waste that can easily be assembled, disassembled, stored, or transported for relocation or reconfiguration.

The free-floating foundation is based on individual load bearing piers resting on grade or level surface and is considered a temporary structure, allowing the system to be utilized by more than just homeowners. Renters, condominium owners and secondary residences, such as cottages or trailers, will benefit from the interlocking and modular system, ideally being able to relocate, reconfigure, expand the system or store the system if desired.

The system components are designed to be easily packaged on and within the dimensions of standardized palettes traditionally used for shipping and storage purposes.

Figure 2:
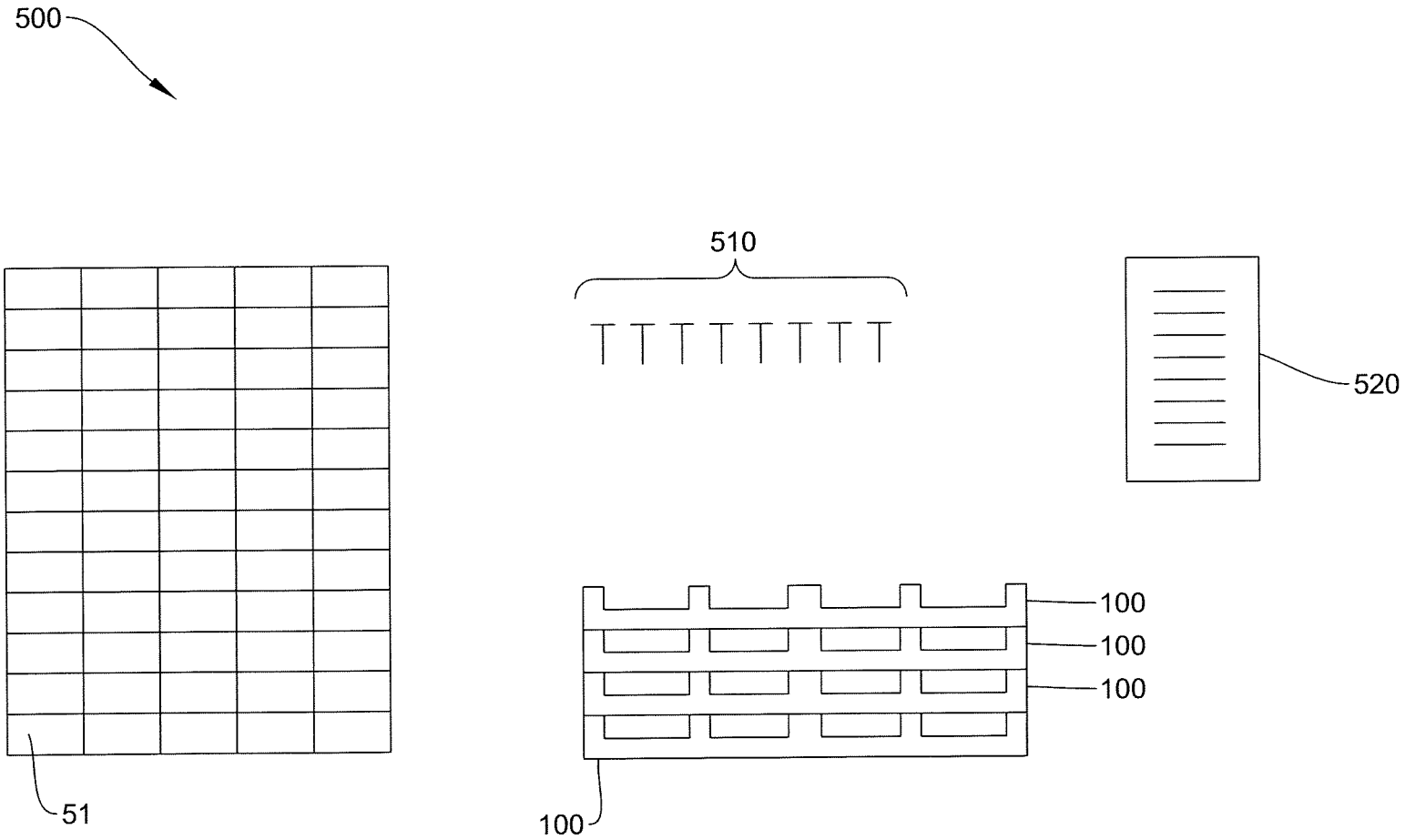
FIG. 2 shows an embodiment of a kit in accordance with the base mat of FIG. 1.

Depicted in FIG. 1 is a one embodiment of a base mat for use in a system for assembling platforms and other similar structures. A molded unitary base mat 100 forms the foundational unit with which to build a walkway, platform, deck and other like structures. The base mat comprises a main body 101 and a plurality of ribs 102, the ribs extending from the main body at an approximately 90° angle. The main body can further include lateral edges 103, 105, and a location where a reflective attachment 104 can be secured. A base mat will also comprise spaces or grooves 106 between adjacent ribs can be selected to fit the size of the particular walkway or deck members to be used in assembling a walkway or deck structure. The orientation of the grooves will by default determine the orientation of the members used to assemble a walkway or deck. Thus, by changing the orientation of base mats one can alter the appearance of a deck or walkway and in turn create various patterns as desired. In some embodiments, a base mat can be formed as a unitary molded object The present invention also provides that the elements required to construct a deck or walkway can be provided in a kit form. As shown in FIG. 2 a kit 500, can include a plurality of base mats 100, a plurality of walkway or deck members 51 (referred to herein as "retaining members"), and a plurality of fasteners 510, with which to secure retaining members 51 to base mats 100. Retaining members comprise a length and a width, a lower retaining member surface 52, an upper retaining member surface 53, and sides 54. Base mats are configured such that a retaining member will fit within a groove 106, such that the lower retaining member surface rests on the base of the groove 107, and the sides of the groove 108 will engage the sides 54 of the retaining member placed therein.

The kits can also include written instructions 520 to guide a user in methods for constructing walkways or decks using the components provide in the kit. The number of base mats and member in each kit can be varied. In some embodiments a kit may comprise the appropriate number of base mats and retaining members in order to construct a pre-designed deck structure, which can then be easily assembled according to the included instructions. Decks can be built in sections, with arrangement of base mats in each section determining the pattern formed by retaining members in the finished product.

As described above, base mats can be of unitary molded construction. Retaining members can be fashioned from any number of linear dimensional construction materials, including plastic composites, wood, metal and the like.

Figure 3:
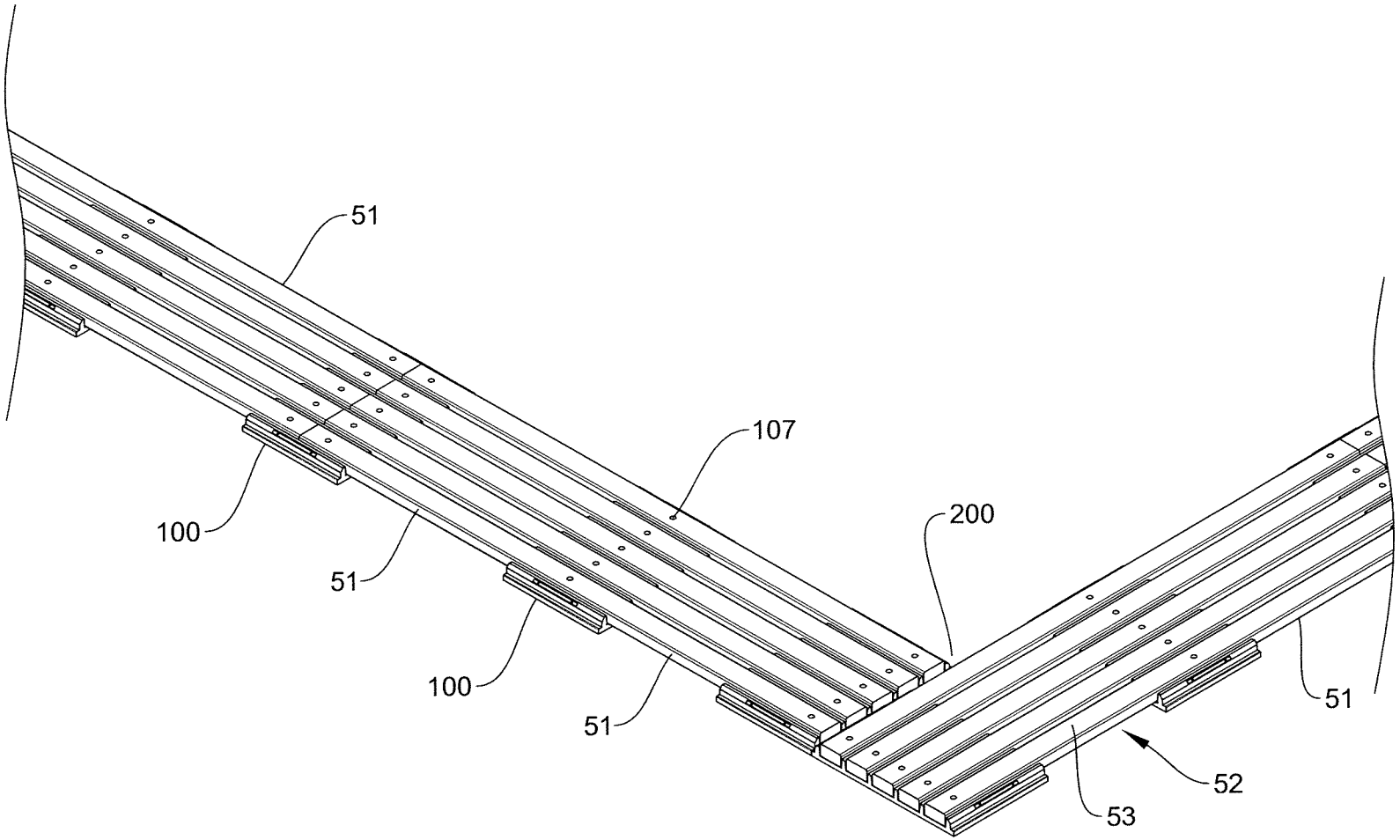
FIG. 3 shows an embodiment of a portion of an assembled walkway using the base mat of FIG. 1.
Figure 4:
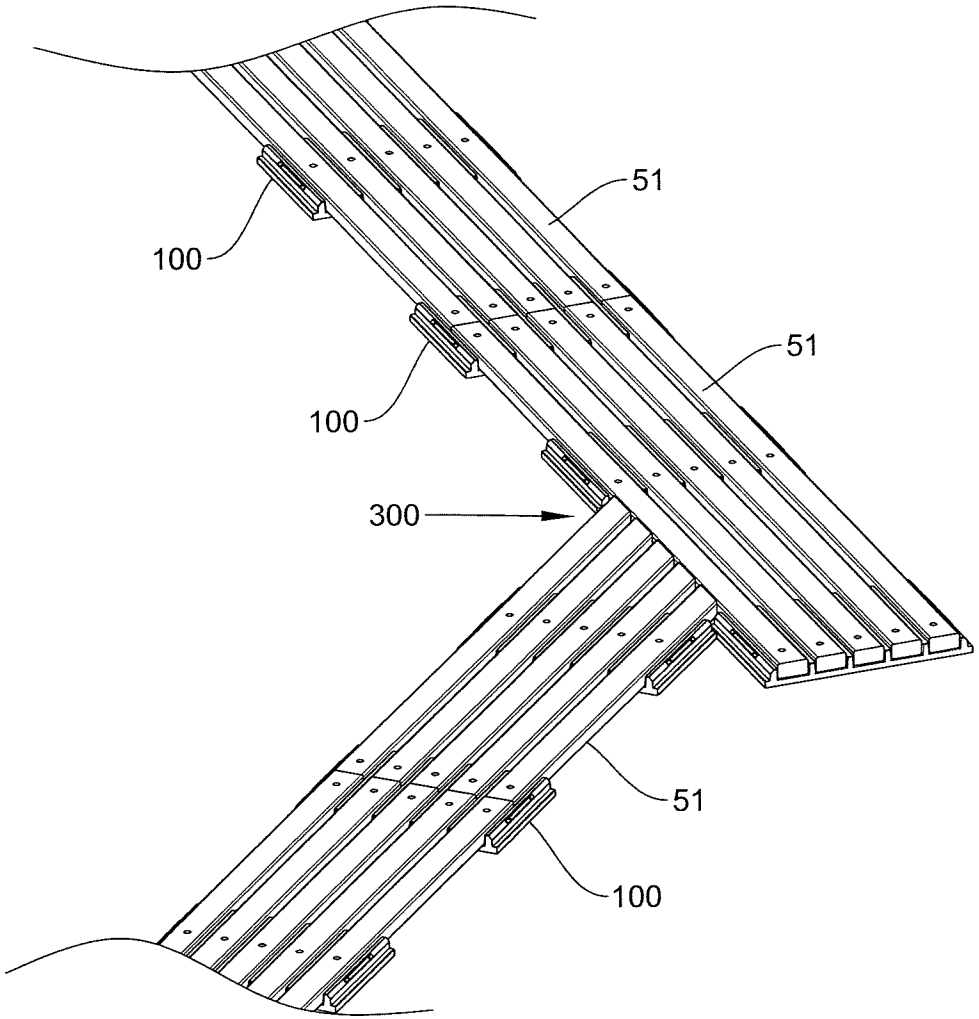
FIG. 4 shows a perspective view of a section of a walkway, and including a 90° junction between two sections of the walkway using the base mat of FIG. 1.

As shown in FIGS. 3 and 4, a walkway can be constructed by placing a number of base mats 100 on a surface over which one desires to assemble a walkway surface. A plurality of retaining members 51 are then placed in the spaces 106. Spacing between mats will be dependent on the length of the retaining members used. For additional security, retaining members 51 can be fastened to mat with fasteners 107. Fasteners can be any of a variety of fasteners known in the art including nails, screws and the like. As also shown in FIG. 3, where a 90° junction 200 is desired, it can be Ruined by simply abutting two mats against each other with the mats rotated 90° relative to each other. Similarly, in order to form junctions at angles other than 90° the members can be assembled and secure to the mat, and then the members cut at the desired angle for the junction, for example a 45° junction 300 an example of which is shown in FIG. 4.

Those of skill in the art will also appreciate that the width of a walkway can be varied by the number of mats placed side by side. Also, depending on the rigidity of the material from which the retaining members are fashioned, one can either increase or decrease the distance between base mats to provide sufficient support to the walkway or deck formed by the members to avoid excessive flexion of members when loaded with either objects, equipment or people. Conveniently, placing retaining members into the grooves in base mats will serve to maintain the base mats in position on the surface on which the deck or walkway is being constructed.

Figure 5:
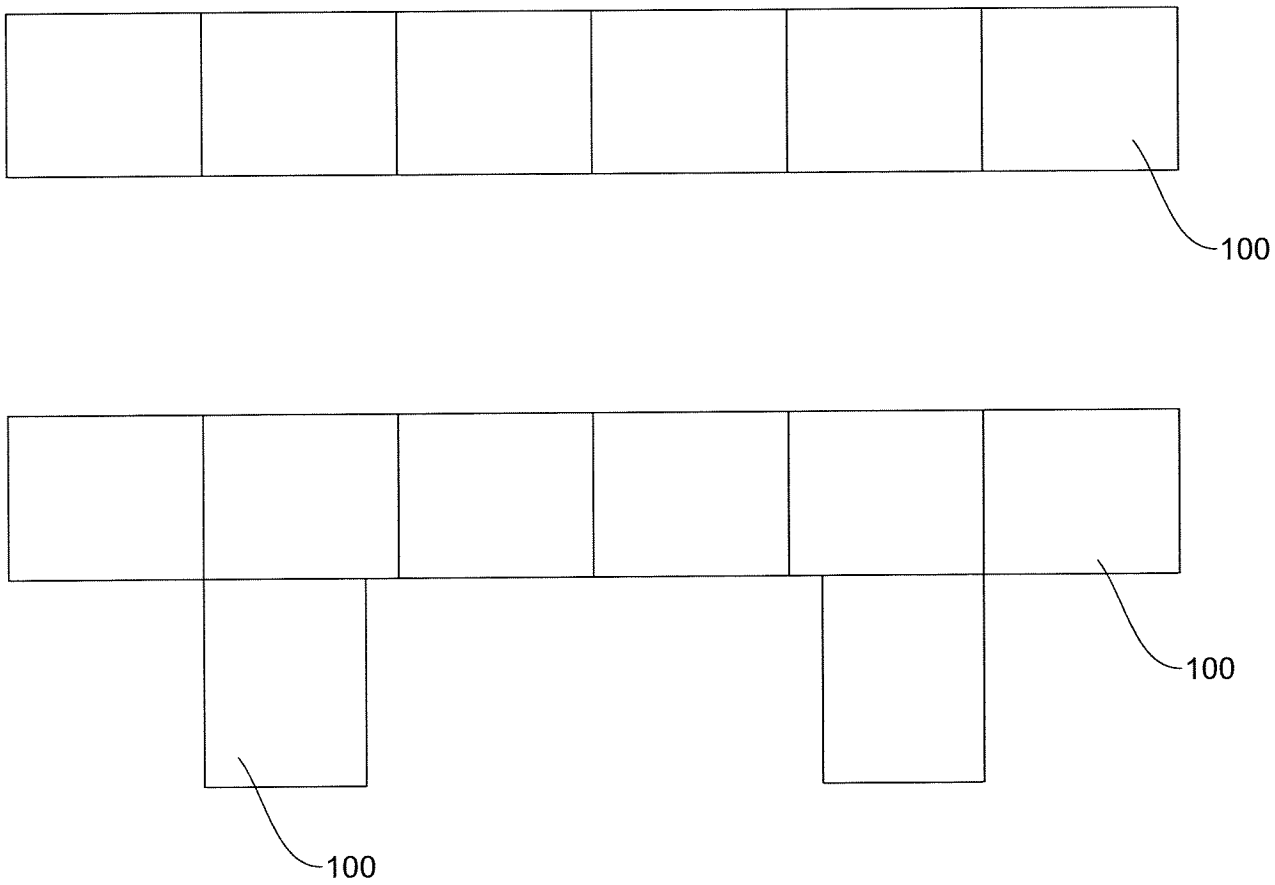
FIG. 5 shows an embodiment where base mats of FIG. 1 to be used in forming a modular deck according to the present disclosure have been positioned on a surface.
Figure 6:
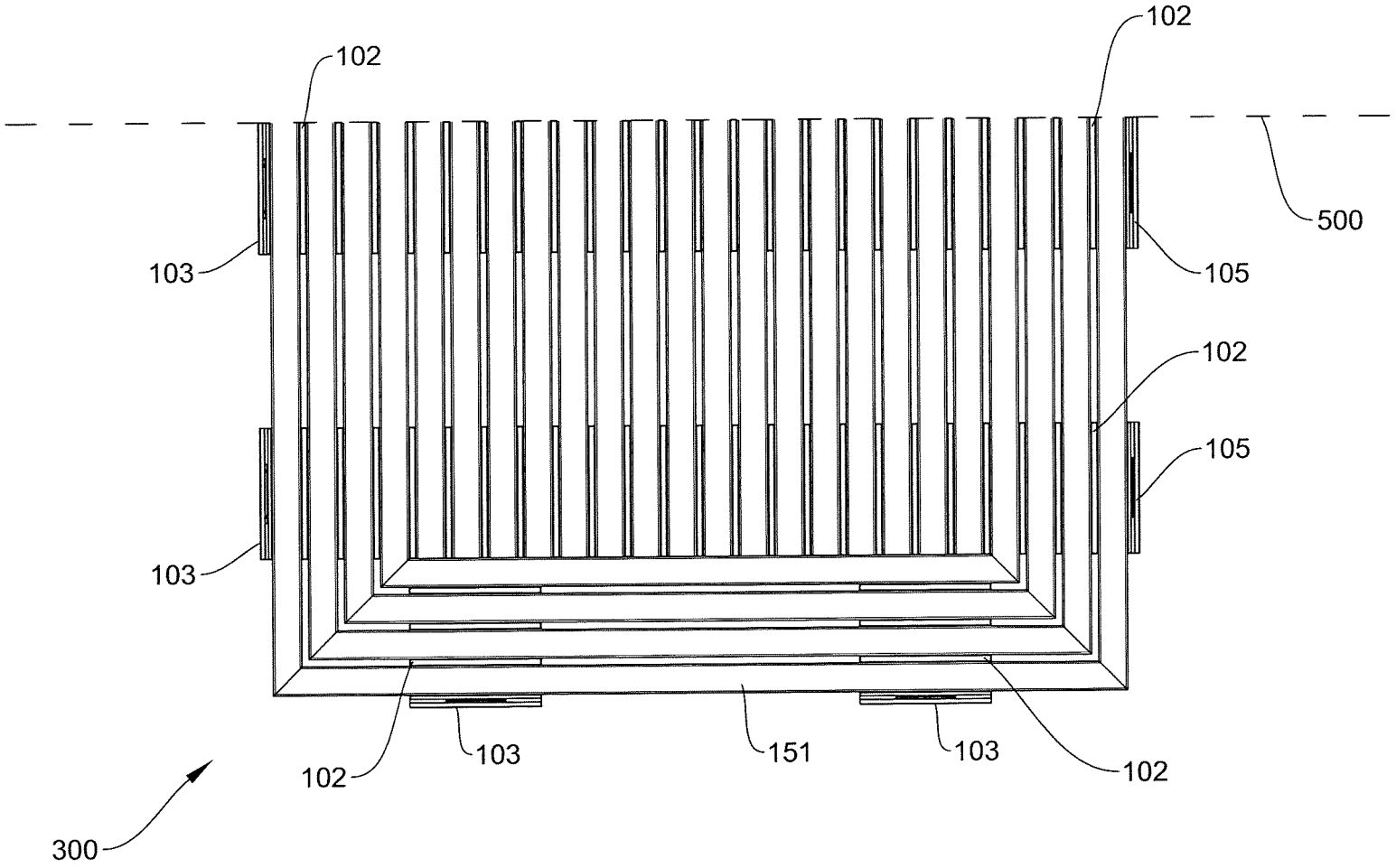
FIG. 6 shows a completed deck structure according to the present disclosure using the base mat of FIG. 1.

As has been described so far, the system can be used to construct walkways, platforms and other similar structures. In some embodiments, the elements of this system can be used to construct a modular deck structure, as depicted in FIG. 5 and FIG. 6. As shown in FIG. 5 a plurality of base mats 100 are laid on a surface, the arrangement used to define the size and shape of the modular deck that will eventually be constructed. In FIG. 5 the grooves in each base mat are not shown to simplify the drawing and make it more understandable to those of skill in the art. FIG. 6 shows an embodiment of a completed deck structure, showing retaining members 151, and ribs 102 extending up into the space between adjacent retaining members.

Figure 7:
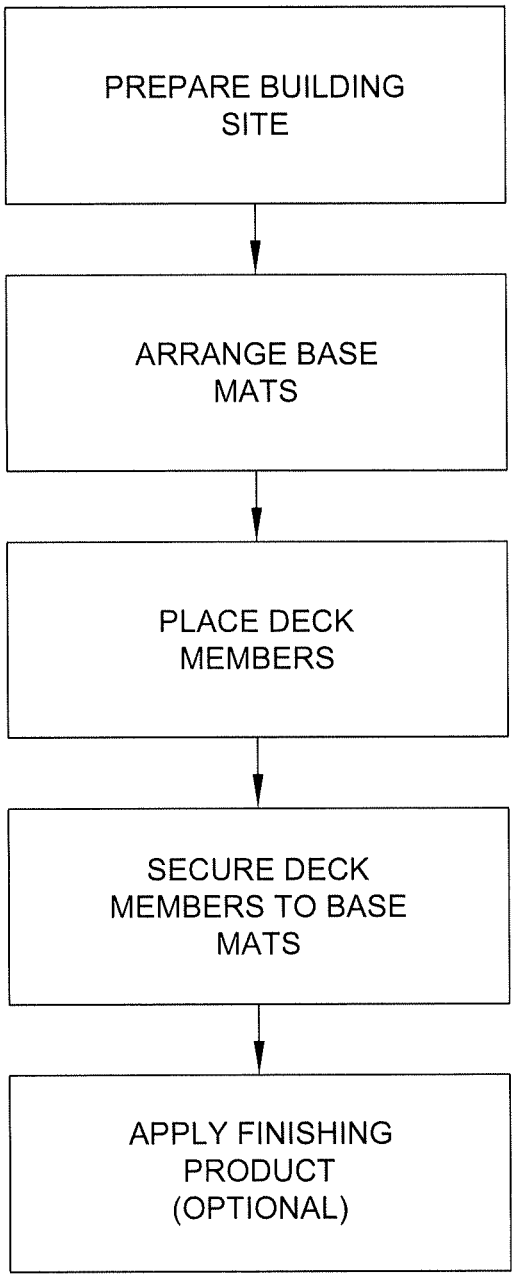
FIG. 7 is a flowchart showing the steps of one embodiment of the modular decking construction method of the present invention.

FIG. 7 provides a flowchart outlining the steps in an embodiment of a method of constructing a modular deck according to the present disclosure. To construct a modular deck, one will first prepare the surface on which the deck is to be constructed. The present system is well-adapted for building decks on virtually any surface, including the ground, concrete gravel, and the like. Base mats are then placed upon the surface where the modular deck is to be constructed. The precise number and arrangement of mats will depend on several factors, including but not limited to the desired shape of the modular deck, the area the modular deck is to cover, and the mechanical properties of the material to be used as retaining members.

Those of skill in the art will appreciate that most of the materials contemplated as being useful as retaining members will be lineal dimensional construction materials made from wood, composites, metal and the like. In one embodiment, it will be convenient to use 2×4 lumber cut to desired length as the retaining member. Other dimension may be used if desired, and the dimension of the retaining members are not limiting to the scope of the invention.

Retaining members are placed in the grooves in the base mats to produce the deck surface. Although not required, for increased structural integrity, retaining members may be secured to base mats with fasteners such as screws or nails, or by the use of adhesives. Depending on the nature of the lineal dimensional construction material used for retaining members, optionally it may be desirable to apply a finishing product to the deck surface to protect the deck from the elements. For example, if wood retaining members are used, it may be desirable to apply a protective coating of paint, varnish, or other similar product.

Depending on the dimensions of the retaining members in terms of width, thickness and length, a certain amount of flexing will occur as the member is loaded, either by objects or people, or both. Thus, in designing the modular deck, attention will be paid to the spacing between base mats at various positions throughout the modular deck area. For example, and as shown in FIG. 5 and FIG. 6, an embodiment of a modular deck 300 has been designed to abut an existing structure 500 (e.g., the side of a dwelling or commercial building).

A modular deck of the present disclosure may also be constructed as a temporary or permanent structure and may be freestanding or connected to another structure or building. For example, in one embodiment, a modular deck of the present disclosure can be constructed and placed in an area as desired without permanent attachment to the surface on which it is placed or to any other structure or building. In this way, temporary decking for an event could be constructed, and then readily disassembled when no longer required.

In contrast, it may be desirable to build a modular deck that is intended to be a more permanent structure. In this case the base mats might be secured to the surface on which the modular deck is to be constructed, for example concrete bolts extending through the base mat to secure it to a concrete pad. Alternatively, various types of anchoring components might be used to secure base mats to the ground under the modular deck. Those of skill in the art will also appreciate that it will be possible to elevate a modular deck constructed in this way by providing an underlying structure onto which base mats can be secured. The materials and methods described herein are especially well-adapted for rapid assembly of decks for residential purposes, such as a modular deck one might have in a back yard, or surrounding a swimming pool area, and the like.

Figure 8:
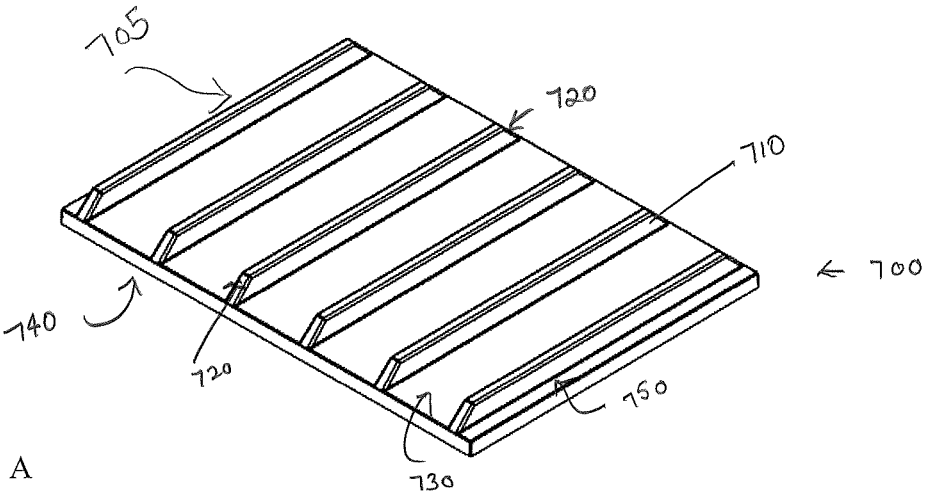
FIGS. 8A-8C shows non-limiting examples of a variation of the base mat of FIG. 1, 8A shows dividers chamfered at either end and no reflective stripe chamfer; 8B further shows variations in length; and 8C shows further variation in width.
Figure 8:
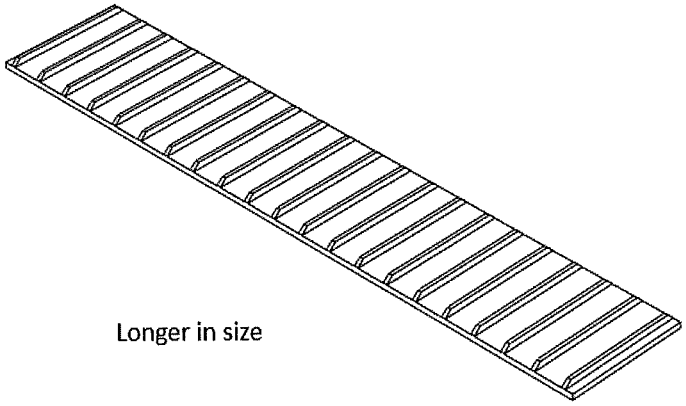
Figure 8:
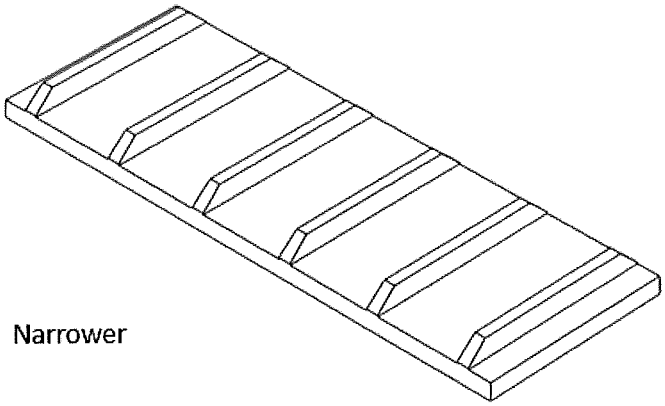

FIGS. 8A-8C show a further embodiment of the base mat shown in FIGS. 1-6 where the base mat body is modified. Referring to FIG. 8A, the base mat 700 remains a unitary body with a top surface 705 and configured with thinner and shorter dividers 710. Each divider 710 has a chamfered end 720. Five channels 730 are shown for receiving retaining members therein. Along each periphery length of the base mat body is a side support 750. Side supports 750 for receiving joiner boards (joiner retaining members). The base mat is a unitary structure where the dividers, the channels and the side supports are integrally formed. The base mat 700 body is configured with a thinner body and thus overall is lighter. The base mat 700 has a bottom ground engaging surface 740. As part of a floating platform assembly, reflective attachments are not incorporated in this embodiment.

Thinner dividers advantageously leave smaller gaps between boards preventing chair legs/feet, outdoor waste, shoe heels and the like getting through or caught into the gap. Chamfered ends 720 may aid in water drainage and in the molding process. Shorter dividers, that is, the length of the divider that extends upwardly from the top surface of the base mat is less than the thickness of any retaining member laid into the channel. This aids not only in water drainage, but also to the esthetic look of the finished platform assembly as the dividers are not as visible.

As shown in FIG. 8B, the base mat 700 can be molded into a longer size with several more channels 730. As shown in FIG. 8C, the base mat 700 can be molded into a narrower size.

Figure 9:
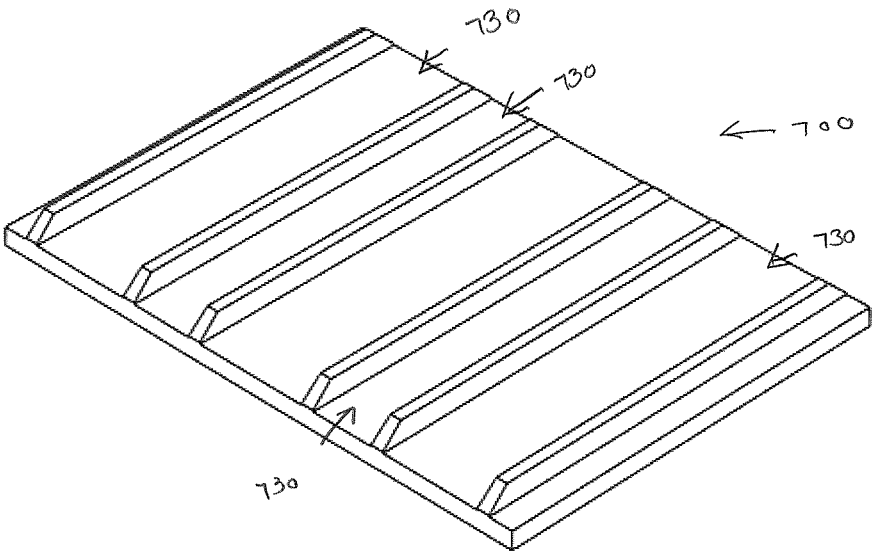
FIG. 9 shows a non-limiting example of variable gap distances in a base mat.
Figure 10:
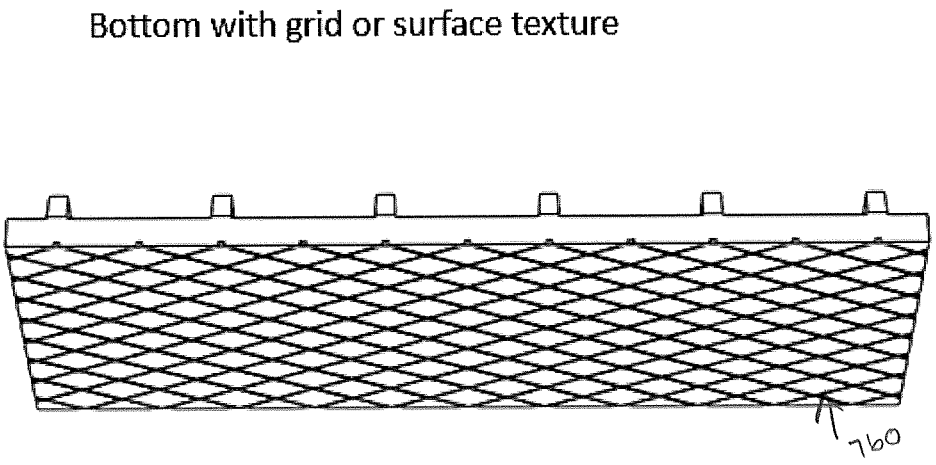
FIG. 10 shows a non-limiting example of a base mat with bottom surface comprising a grid or surface texture.

Referring to FIG. 9, the base mat 700 is shown combining channels 730 of varying width to accommodate different sized retaining members for a different esthetic look. FIG. 10 shows a base mat 700 with a textured grid surface 760 on the bottom ground engaging surface 740 that can provide additional grip on a surface.

Figure 11:
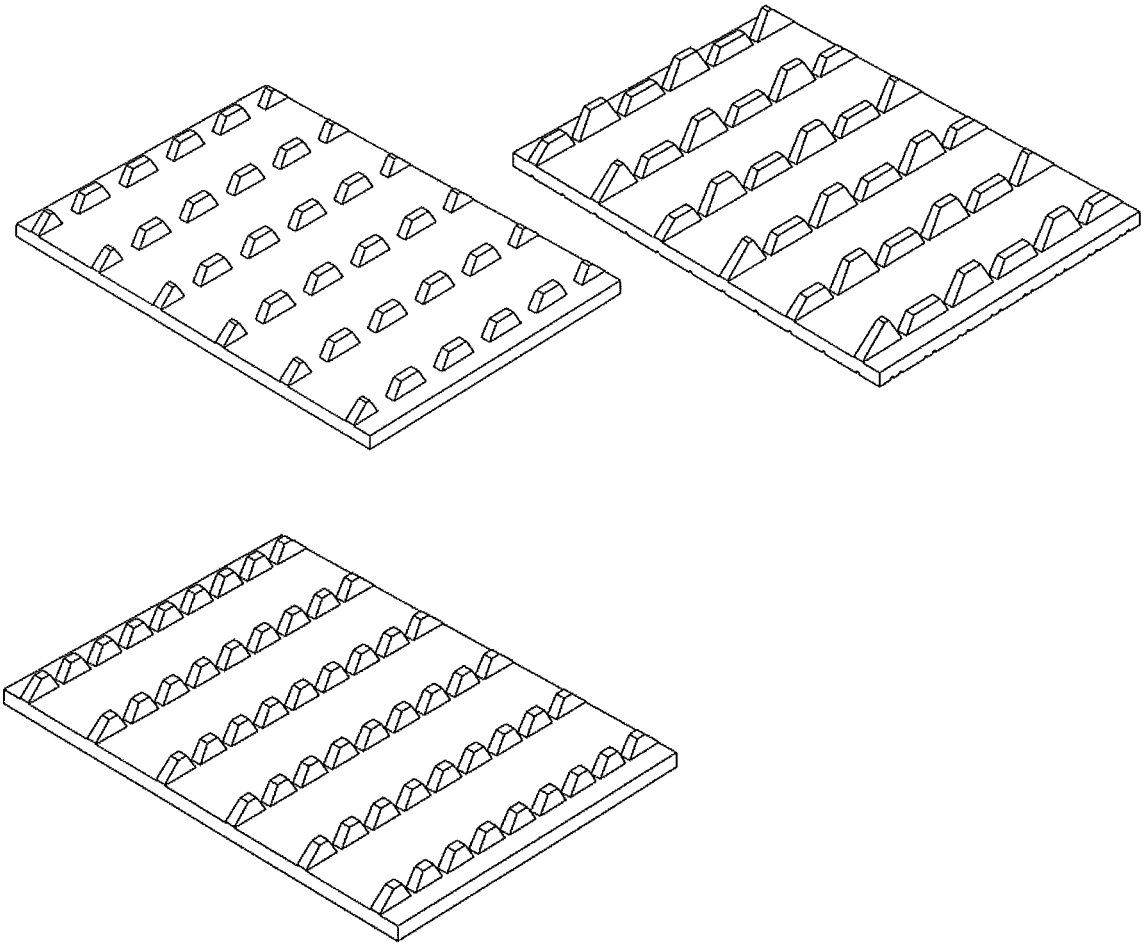
FIG. 11 shows non-limiting examples of a base mat with non-continuous dividers (ribs) and varying lengths of dividers.

FIG. 11 shows a base mat 700 with non-continuous dividers 710 of varying lengths, that is, the length of the divider that extends upwardly from the top surface of the base mat. Although the length may vary, it remains less than the thickness of any retaining member laid into the channel.

Figure 12:
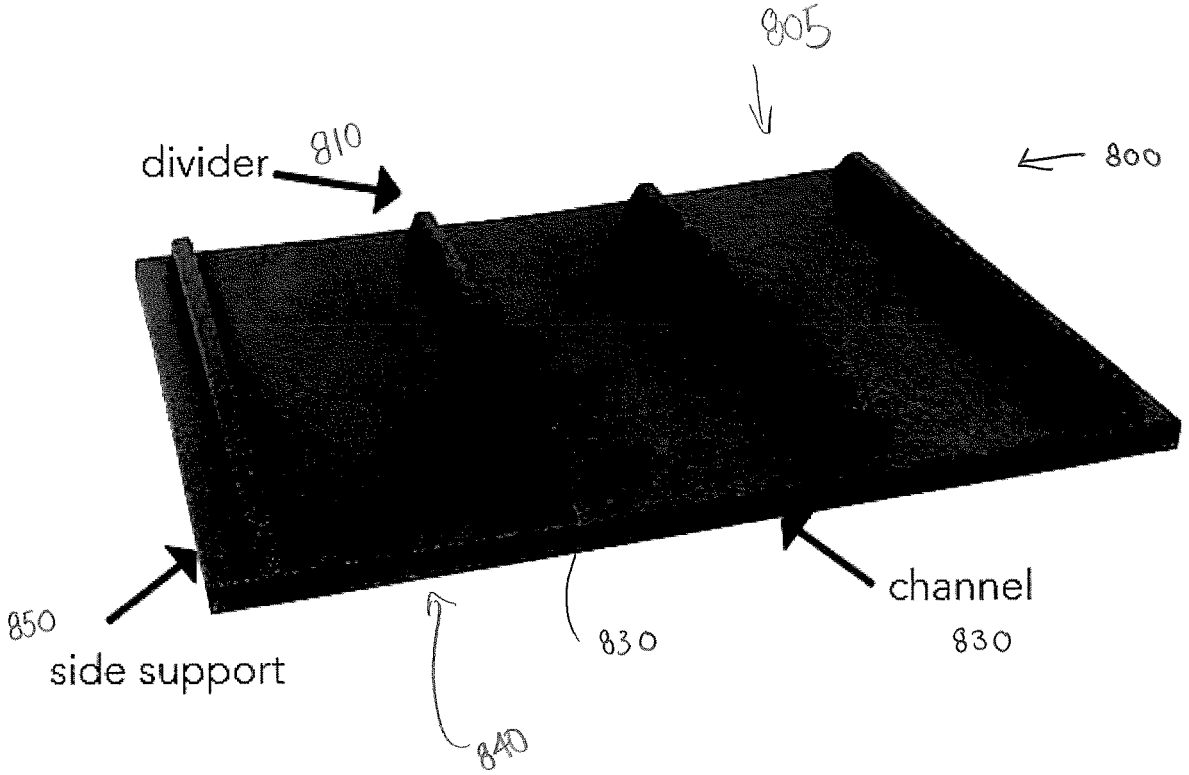
FIG. 12 shows a further embodiment of a base mat in accordance with the present invention.

Referring to FIG. 12 is shown a further embodiment of a base mat 800 similar to that shown in FIG. 8A. The base mat 800 has a top surface 805 and a bottom ground engaging surface 840. In this embodiment the body is configured with three wider channels 830 for receiving wider retaining members, e.g. boards/planks. In this embodiment, standard board/plank material of about 1'×6" can be used for a building a different esthetic look for a floating platform assembly. The base mat 800 is shown with 4 dividers 810, each divider having chamfered ends 830 and lateral side supports 850. The dividers 810 extend upwardly from the top surface 805. The dividers have a length that extends upwardly from the top surface of the base mat that is less than the thickness of any retaining member laid into the channel.

The base mat comprises a unitary rubber body and thus it is stable and slip-resistant ensuring that the floating assembly remains in place.

In embodiments, the molded unitary base mat is made from recycled rubber materials, heated and formed into the desired shape using well known molding processes. Retaining members as described above can be fashioned from industry standard size planks or boards that can be fashioned from wood, composites or other suitable materials.

In aspects, the compositions of the invention can comprise particles of crumb rubber that is admixed with particulate polyolefin to form a mixture for molding. In aspects, the crumb rubber can comprise SBR mixtures that may comprise EPDM.

The crumb rubber may be obtained from any variety of sources or suppliers and is often derived from old used scrap tires or recycled rubber. In aspects rubber can be a synthetic rubber selected from styrene-butadiene rubber (SBR—a copolymer of syrene and butadiene), ethylene propylene diene rubber (EPDM—a terpolymer of ethylene, propylene and a diene-component), ethylene propylene rubber (EPR), butadiene rubber (BR) and mixtures thereof. Any rubber source can be of a recycled nature. The crumb rubber for use in the invention can be of a variety of mesh sizes and mesh sizes mixtures, for example up to about 80 mesh. In aspects, the crumb rubber is up to about 10 mesh or up to about 20 mesh.

Any polyolefin having a melt index ranging between about 5 g/10 minutes to about 50 g/10 minutes is suitable for use such as polyethylene, polypropylene, polybutene, polyisoprene, polypentene and mixtures thereof. In aspects the polyolefin is polyethylene or polypropylene. The polyolefin for use in the first dry grind composition is particulate and can be of any desired size up to about 80 mesh.

When heated at temperatures of about 140° C. to about 230° C., inclusive of any specific temperature in between, the polyolefin will melt about the crumb rubber. Any temperature within this range is suitable for use in the method.

The amount of crumb rubber to polyolefin used in the method can range from about 20%:80% by weight to 80%:20% by weight. In aspects about 30-70% by weight of crumb rubber is used in the compositions, in aspects about 60% by weight, and about 50% by weight. In further aspects, 100% of the crumb rubber can be EPDM. In further aspects from about 25% to about 75% by weight EPDM.

The amount of polyolefin used in the final shaped mat is about 15% to about 60% by weight. The amount and type of crumb rubber and polyolefin selected for use may for example be a mix of about 50:50% by weight crumb rubber to polyolefin to achieve a desired shore harness A (where less than 70 is soft; 70 is standard and 90 is stiff) as would be understood by one of skill in the art. This is but one representative and non-limiting example.

Up to about 10% by weight additives can be incorporated as desired to improve certain properties of the end product, as would be understood by a skilled person. These are selected from the group consisting of titanium dioxide, UV stabilizers, calcium carbonate, talc, flame retardants and combinations thereof. The additives can be incorporated into the extruded sheet or within the composition of plurality of shaped particles. Thus the additives are incorporated into the final shaped product. It is also understood that in embodiments of the invention, no additives are incorporated. Up to about 10% by weight colorant can be incorporated into the final mat. It is also understood that in embodiments of the invention, no colorants may be incorporated.

The engineered mats described herein have enhanced durability as being made of recycled crumb rubber composition, the mats are relatively unaffected by moisture and do not rot, rust or corrode. In addition, The recycled crumb rubber composition resists nicks and dents, does not peel, and when impacted, tends to return to its original shape.

Various arrangements of base mats can be made as a foundation system to build a variety of floating platform assemblies. For example, simple straight decks, decks with mitered corner frames, or patchwork designs are all possible.

Conventional wooden or composite boards can be used in any desired stain, paint color to build limitless designs.

The modular foundation system comprising a plurality of base mats can be used to build floating platforms such as decks/patios for small space living, or urban homes with balconies. The floating platform assemblies, such as a deck, need not be attached to a building or the ground and can be dismantled, and transported to a new location such as at a camp and RV site. It is thus re-useable. Small functional decks can be built for storage areas for recycling bins, garbage cans, composting, rain barrels and the like.

EXAMPLES

Figure 13:
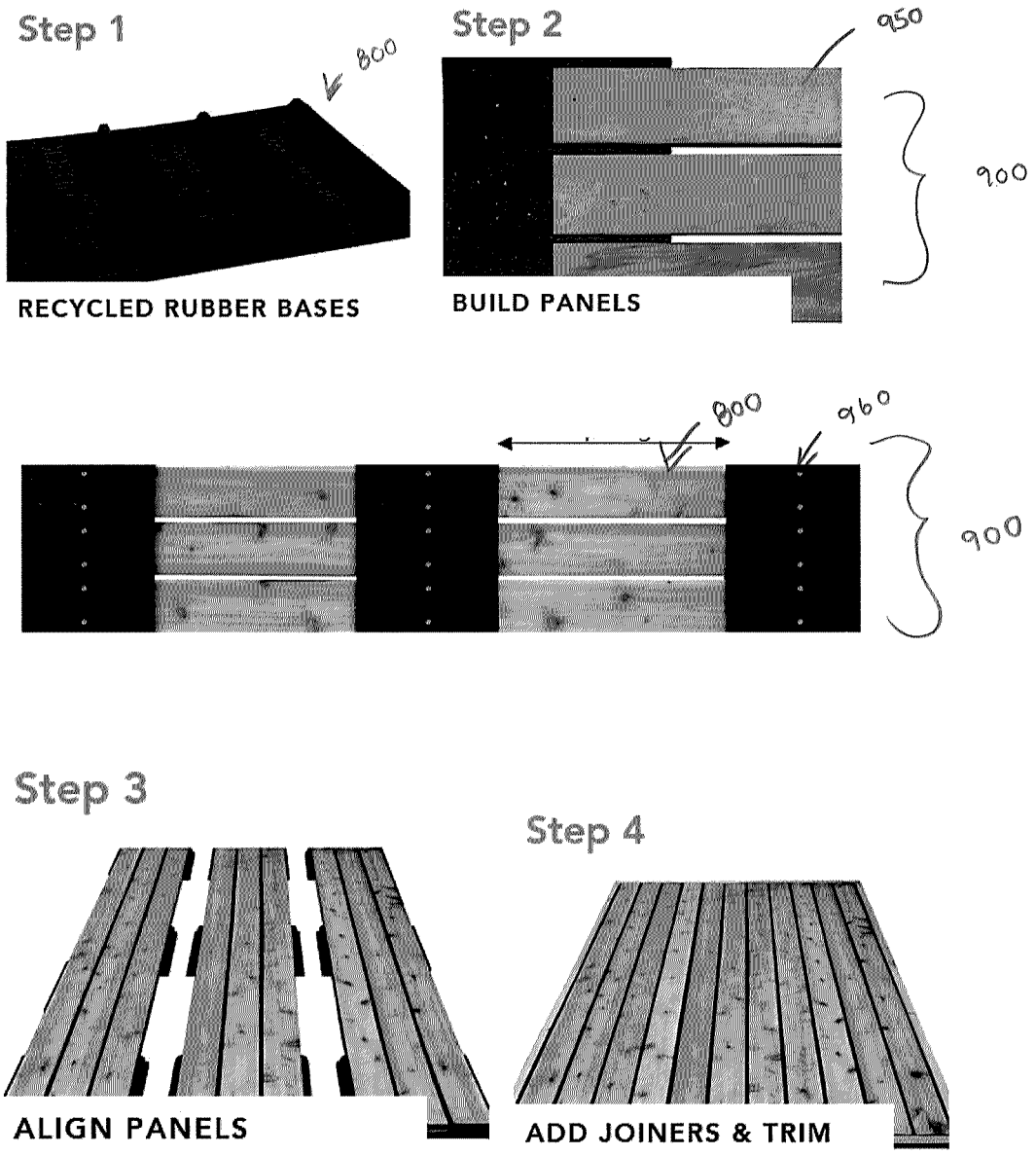
FIG. 13 shows the assembly of panels and a platform using the base mat of the invention.

1. Deck Assembly (FIG. 13)

Ground Preparation

To prepare the ground, the layout and shape of the deck is measured with a hose or string. Ground material is added or removed until a flat surface is achieved. A landscape fabric can be used over the prepared ground (especially sod or active vegetation areas) to prevent growth of plants through the deck boards later in the season.

If the deck is being installed on flat, clear and even concrete, such as a poolside deck or a commercial space such as a restaurant patio, there is no ground prep required.

Build Panel

The rubber bases 800 are used as guides to build panels 900 to hold 6" decking boards or composite boards 950. Each base holds three boards. Optionally, the boards can be attached to the rubber bases with 1⅝" deck screws 960.

If using screws, the wood is placed upside down. Press rubber bases at recommended spacing of maximum 18" between bases. Screws to be inserted at center of each rubber base to secure wood firmly. Six deck screws per rubber base can be used (2 screws per board, each base holds three boards).

As freshly treated deck boards may swell and shrink, as they can dry out. Freshly treated boards if snug, may require tapping with a rubber mallet to fit into the channels.

Panel Connection

To connect the panels, they are turned over so that the rubber bases are now on the ground. Panels are arranged to cover the desired deck space, leaving a gap of about 5½" between each rubber base forming the groove that will accept the joiner boards.

Joiner boards are simply additional 2×6" decking boards, same as those secured to the rubber bases. The joiner boards are added to the spaces between panels. To fasten into place, on either side of the joiner board, the wood may be screwed at a 45 degree angle into the rubber side supports of the base on each opposing panel.

Boards are then inserted between each set of panels to increase width and again optionally secured to base using for example about 1⅝ " deck screws.

Optional Trim

Fully joined, the final deck can be finished with a frame to create a clean look. The frame can add another level of stability to the structure, but it is not needed for utilitarian applications such as platforms for storage.

If a trim is desired the outer side supports of the rubber base can be removed using utility knife or circular saw. Any suitable desired trim can be used, for example a 2×2" wood trim.

It will be apparent to those skilled in the art that many more modifications besides those already described are possible without departing from the inventive concepts herein. For example, it will be realized that the optimal dimensions for the various parts of the invention, materials, shape, form, manner of assembly, and operation or use will be apparent to those of skill in the art. The inventive subject matter, therefore, is not to be restricted except in the scope of any claims as may be directed to the disclosure presented herein. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. All suitable modifications and equivalents that may be resorted to are thereby considered to be within the scope of the present invention.

The invention claimed is:

1. A re-useable, transportable, and eco-friendly base mat of a unitary molded body comprising:

a top surface with spaced apart upwardly extending dividers forming a plurality of channels, each of the plurality of channels configured for receiving a retaining member therein, between the upwardly extending dividers, and each of the plurality of channels continuing substantially the full length of the body;

a bottom ground engaging surface; and laterally extending side support members, wherein the length of the upwardly extending dividers is less than the thickness of the retaining member laid within the channel;

wherein the bottom ground engaging surface is textured for providing additional grip on a surface, and wherein the base mat is formed from a recycled rubber composition.

2. The re-useable base mat of claim 1, wherein the recycled rubber composition comprises a mixture of crumb rubber and polyolefin in a ratio of from about 20%:80% by weight to 80%:20% by weight.

3. The re-useable base mat of claim 1, wherein each of said spaced apart upwardly extending dividers have chamfered ends; and/or wherein one or more of said spaced apart upwardly extending dividers are not continuous.

4. The re-useable base mat of claim 1, wherein one or more of said spaced apart upwardly extending dividers are of a different length.

5. The re-useable base mat of claim 1, wherein the plurality of channels comprise one or more different widths.

6. The re-useable base mat of claim 1, comprising five channels.

7. A modular foundation system comprising a plurality of the re-useable base mat of claim 1.

8. A panel comprising one or more of the re-useable base mat of claim 1, and a retainer member in each of said channels.

9. A floating platform assembly comprising a plurality of adjoined panels of claim 8.

10. The floating platform assembly of claim 9, further comprising a border at the periphery of the assembly.

11. The floating platform assembly of claim 9 wherein said platform assembly is not permanent.

12. The floating platform assembly of claim 9, wherein the platform assembly is a boat dock, decking, patio, walkway, paths, boardwalks, jetties, pier, promenade, verandah, balcony or small crossings.

13. The floating platform assembly of claim 9, wherein the platform assembly is assembled on a ground surface selected from dirt, sand, gravel, sod, cracked pavement, wood, stones and cement.

14. A kit comprising one or more re-useable base mat of claim 1 and instructions for use to make a floating platform assembly.

15. A re-useable, transportable, and eco-friendly base mat of a unitary molded body, comprising:

a top surface with spaced apart upwardly extending dividers forming a plurality of channels, each of the plurality of channels configured for receiving a retaining member therein, between the upwardly extending dividers;

a bottom ground engaging surface; and laterally extending side support members;

wherein the length of the upwardly extending dividers is less than the thickness of the retaining member laid within the channel;

wherein the bottom ground engaging surface is textured for providing additional grip on a surface; and further comprising up to about 10% by weight additives selected from the group consisting of titanium dioxide, UV stabilizers, calcium carbonate, talc, flame retardants and combinations thereof; and/or up to about 10% by weight colorant.

16. A method of constructing a modular deck, the method comprising:

a. providing a plurality of the base mats of claim 1;

b. providing a plurality of retaining members, each retaining member having a length and a width, lower retaining member surface, an upper retaining member surface, and retaining member sides;

c. positioning the plurality of the base mats on a surface on which the modular deck is to be constructed, to define a desired perimeter, shape and area of the modular deck being constructed; and d. sequentially positioning retaining members into said plurality of channels of the positioned base mats until the desired perimeter, shape and area of the modular deck is substantially achieved.

17. The method of claim 16, wherein the modular deck comprises a plurality of sections in which orientation of retaining members within each section is distinct from orientation of retaining members in an adjacent section.

18. The method of claim 16, wherein the retaining members comprise dimensional lumber or construction composite.

19. The method of claim 16, furthering comprising applying reflective markings at desired locations on the modular deck.

20. The method of claim 16, wherein a retaining member is secured to the base mat for engaging it with a fastener, adhesive or combinations thereof.

* * * * *